US005973250A

United States Patent [19]

Zirille et al.

[11] Patent Number: 5,973,250

[45] **Date of Patent: *Oct. 26, 1999**

[54] MINIATURE MULTIPLE AUDIO HIGHLIGHT PLAYBACK DEVICE

[75] Inventors: Anthony M. Zirille, Fort Wayne, Ind.; Takaaki Kondo, Gifu, Japan

[73] Assignee: Anthony M. Zirelle, Fort Wayne, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,171

[22] Filed: Sep. 12, 1996

Related U.S. Application Data

[60] Provisional application No. 60/003,599, Sep. 13, 1995.

[51] Int. Cl.[6] ..... G10H 1/34; G10H 1/46; G10H 7/00

[52] U.S. Cl. ..... 84/600; 84/609; 84/633; 84/644

[58] Field of Search ..... 84/600, 644, 670, 84/94.1, 94.2, 95.1, 95.2, 609–614, 633–638

[56] References Cited

U.S. PATENT DOCUMENTS

| | | | |
|---|---|---|---|
| 3,691,312 | 9/1972 | Petersen | 179/100.2 |
| 3,857,191 | 12/1974 | Sadorus | 40/28.1 |
| 4,045,327 | 8/1977 | Noma et al. | 204/299 R |
| 4,222,188 | 9/1980 | Tarrant et al. | 40/152.1 |
| 4,318,188 | 3/1982 | Hoffman | 265/45 |
| 4,551,114 | 11/1985 | Hyman et al. | 446/397 |
| 4,651,613 | 3/1987 | Harrison | 84/95.2 |
| 4,791,741 | 12/1988 | Kondo | 40/124.1 |
| 4,836,075 | 6/1989 | Armstrong | 84/95.2 X |
| 4,905,029 | 2/1990 | Kelley | 354/76 |
| 4,983,996 | 1/1991 | Kinoshita | 354/76 |
| 4,990,092 | 2/1991 | Cummings | 434/317 |
| 5,092,810 | 3/1992 | Kwan et al. | 446/268 |
| 5,130,696 | 7/1992 | Liebman | 84/94.2 X |
| 5,135,426 | 8/1992 | Lin | 446/408 |
| 5,147,237 | 9/1992 | Kwan et al. | 446/297 |
| 5,166,851 | 11/1992 | Jacobson . | |
| 5,200,566 | 4/1993 | Shimaya | 84/609 |
| 5,209,665 | 5/1993 | Billings | 434/169 |
| 5,228,879 | 7/1993 | Fromm | 446/219 |
| 5,247,126 | 9/1993 | Okamura | 84/609 |
| 5,254,007 | 10/1993 | Eagan | 434/319 |
| 5,260,512 | 11/1993 | Chomette et al. | 84/644 |
| 5,288,069 | 2/1994 | Matsumoto | 273/65 |
| 5,349,129 | 9/1994 | Wisniewski et al. | 84/600 |
| 5,350,880 | 9/1994 | Sato | 84/609 |
| 5,359,374 | 10/1994 | Schwartz | 354/76 |
| 5,368,517 | 11/1994 | Pagani | 446/297 |
| 5,375,839 | 12/1994 | Pagani | 273/58 E |
| 5,410,097 | 4/1995 | Kato et al. | 84/610 |
| 5,438,154 | 8/1995 | Segan et al. | 84/600 |
| 5,498,833 | 3/1996 | Huang | 84/94.1 |
| 5,508,471 | 4/1996 | Shimada | 84/610 |
| 5,569,868 | 10/1996 | Leung | 84/600 |

*Primary Examiner*—Stanley J. Witkowski
*Attorney, Agent, or Firm*—Baker & Daniels

[57] ABSTRACT

The present invention involves a microelectronic device capable of audio playback of highlights, in conjunction with products such as a gift box or a "base" for nostalgia and memorabilia such as a gift or music box (20) with its base (22) and hingedly attached lid (24), or a base supporting an object of interest. A switch (26) or light sensor or other actuation device is mounted in or on the base and is coupled to a circuit board (28) also disposed in the base. The switch is open and the circuit is inactive when lid (24) rests atop base (22), but the switch closes when the lid is opened to activate the circuit board. In the alternative a manual switch, such as a press-button switch, may be used to activate the replay function. The circuit board, when activated, audibly reproduces "highlights", which is audio information sufficiently long to cover a significant event, e.g., a portion of a political speech, a play from a sporting event, a climatic point of a drama or movie, or a broadcast news event yet short enough not to take an inordinate amount of time from the present. Further, the "highlights" should be able to be played in a multiple, consecutive or semi-random order. A ROM chip (30) digitally stores a plurality of highlights which are retrieved and audibly reproduced by a processor (34) on the circuit board when actuated by the switch. The circuit board may be disposed in a gift, music or keepsake box, sports and entertainment memorabilia, cards, frames, statuettes, bases, clocks, and similar items.

48 Claims, 7 Drawing Sheets

U5
32'
1
16
8
9
C25
U2
30
Vdd
A16
A15
A12
A7
A6
A5
A4
A3
A2
A1
A0
o0
o1
o2
GND
A18
A17
A14
A13
A8
A9
A11
OB
A10
CB
o7
o6
o5
o4
o3
C21
CX2
CX3
C14
C15
U3
34
28

MINIATURE MULTIPLE AUDIO HIGHLIGHT PLAYBACK DEVICE

CROSS-REFERENCE TO RELATED APPLICATION

This application claims the benefit under Title 35, U.S.C. § 119(e) of U.S. Provisional Patent Application Ser. No. 60/003,599, entitled MINIATURE AUDIO HIGHLIGHT PLAYBACK DEVICE, filed on Sep. 13, 1995.

FIELD OF THE INVENTION

The present invention generally relates to microelectronic devices to be incorporated into consumer products. More particularly, the present invention relates to novelty memorabilia items having miniature microelectronic audio playback features.

Description of the Related Art

It seems more than ever before, consumers across the world are interested in purchasing videos, clothing, music and novelty items which have some kind of historical or personal nostalgic significance. Music from decades past has made a come-back, sports cards of history's "greats" increase in value daily and novelty souvenir items and T-shirts are bought by those in attendance at most newsworthy and sporting events. Specifically, of increasing popularity are audio and video compilations of historical newsclips, sporting events and popular music and movie segments.

In the music arena, compilations of music hits from selected eras or selected writers or performers are sold on compact discs and cassette tapes. These media, however, are large in size compared to micro-chip technology. Further, they require additional, costly playback units such as compact disc and tape players for their enjoyment. In the entertainment arena, talking children's books and videos provide certain audio reproductions of popular children's books and movies. Although incorporating certain microchip technology, the electronic mechanisms in talking children's books provide only limited replay capacity. These mechanisms are used effectively for barnyard sounds and short children's songs, yet are inadequate for extensive movie, dialogue or music excerpts.

With respect to currently popular entertainment-related novelty items, such as audio record and playback greeting cards and frames, the focus of these products is on a user's recording his or her own voice or an event he or she attended. However, these items do not utilize the playback technology for replay of historic or nostalgic sports and news events, music, television, cinematic, or theatrical programs or other prerecorded selections, to be played in a skillfully and purposefully compiled consecutive order. Further, the technology incorporated into these cards and frames limits their uses with respect to length of the recordings and does not allow for multiple, consecutive, prerecorded selections.

Finally, in the area of sports replays and highlights many different kinds of media have been incorporated into audio-related sports memorabilia and novelty items. Similar to music compilations, compact discs and cassette tapes with compilations of sports highlights and music are currently bought and sold throughout the world. As discussed in more detail in connection with the invention described herein, however, these media do not provide a durable or space efficient mechanism to evoke the users memories of these highlights in a convenient form.

Although audio playback media are utilized to replay historic and nostalgic news, sports events and music, the prior art lacks a small, energy efficient, non-mechanical, electronic medium with multiple and consecutive playback capacity through which a user can enjoy lengthy audio reproductions. What is needed is such a medium for incorporating sports, news, music and personal highlight clips and compilations with historic or nostalgic value into individual consumer-oriented novelty items and memorabilia that act as visual cues relating to the highlight and which are artfully evocative of the content of the highlight.

With respect to traditional music boxes, such as those found at jewelry stores and other retail outlets, which store various objects, such as jewelry, keys and change, and which when opened play a musical selection, the musical playback function is generally quite limited. The apparatus used to generate the musical playback in traditional music boxes is most commonly purely mechanical and requires the winding of a knob to store energy for powering the musical playback device. The music generating device generally consists of a coil spring and a gear network which drive a music storage medium, such as a tube having raised portions which strike sound generating chimes in a preprogrammed sequence to play a musical piece. Each time the music box lid is opened the music begins to play, if properly wound, and each time the music box lid is closed the music stops. Upon each successive opening of the music box lid, the music begins playing at that point in the musical selection where it left off previously when the lid was last closed. The user has no ability to stop the selection in mid-play and reset it to the beginning of the next selection or choose from any number of selections.

What is needed is an apparatus that can play actual, prerecorded musical excerpts, as opposed to mechanical reproductions which only imitate prerecorded music. Further, the ability to provide actual vocals is absent in traditional music boxes. Another need, yet heretofore absent, is for a music box that plays multiple songs, providing a greater spectrum of musical selections. Both with single and multi-play music boxes, however, an important feature lacking is the ability to stop a song, by closing the box, and open the box to a new song, rather than the same spot of the old song. The multi-play capability provided by the microelectronics and specially configured circuitry of the present invention meets these needs, taking music boxes into the next stage of the modern era.

SUMMARY OF THE INVENTION

The present invention relates to the incorporation of audio highlights of full, prerecorded selections of sports and news events, music, television programs, theater, and other prerecorded selections into artfully displayed memorabilia and other novelty items using a microchip storage medium. Specifically, in one form, this invention provides sports fans and history buffs with an opportunity to relive multiple, memorable sports and historical events previously broadcast on local or national television and radio stations through items of memorabilia or other novelty devices. This invention can also be configured as a toy, board game and other entertainment or memorabilia item which incorporates sound "bytes" from popular movies, music and personalities, television shows, news reports and personal or previously recorded comments of the user, his or her family and friends.

For example, with respect to sports highlights, this invention provides a modern, micro-technological means to enjoy multiple replays of a user's favorite "play-by-play" as originally announced by the radio and television announcers of the time. Prior to this invention, reliving such memories through audio-concentrated memorabilia and novelty devices was achieved through larger, more cumbersome magnetic cassette tapes, digital audio tapes or compact disks. Using a micro-chip, this invention provides a more size-efficient audio medium. Further, the electrical aspect of this invention provides a more durable technology by minimizing the need for mechanical parts.

Nostalgia plays an important role in modern sports and popular culture. Just as the scent of freshly popped popcorn or the air on a spring morning can rouse memories of childhood or memories of time spent with family and friends; for many, hearing the replay of a great sports moment of their favorite team can evoke the same sense of nostalgia. Hearing the roar of the crowd as your favorite sports announcer screams "its good!" or "touchdown!" provides a personal, unique sense of timelessness that gives nostalgic sports and entertainment products their popular appeal. For example, most Americans feel a unique sense of the emotion and patriotism when they hear the replay of the United States hockey victory over the Soviet Union in the 1980 Olympics ("Do you believe in miracles!?"). This invention lends itself ideally to the incorporation of highlights into memorabilia and novelty devices. Using audio, as opposed to video replays, this invention allows its users to view in their mind's eye the sports moment as they remember it. Prior to the advent of television, sports fans would huddle by the radios to hear their favorite teams play or save money for weeks to go to the "big game". Reproduced pictures do not allow for the same unique and personal nostalgic trip through the memory and imagination as audio micro-technology allows. At the same time, however, the embodiment of the highlights in related memorabilia or a novelty item provides a visual prompt sufficient for background and contextual purposes.

This invention is designed, manufactured and tailored to provide optimal enjoyment of sports or other audio-related memories. On one hand, sports highlights (for example), by their nature, must be long enough to allow for the set-up of a play, the play itself, the reaction of the crowd and the excitement in the voices of the announcers. Without these aspects, a sports highlight does not provide an apt opportunity for the user to lose him or herself in the nostalgic moment. On the other hand, such highlights, by their nature, must also be short enough to not burden the user with play after play and endless commentary. Video tapes, cassette tapes and compact disks are presently available for this kind of long-lasting and detailed enjoyment. By using highlights ranging from 10 seconds to 120 seconds, a sports fan is provided with just enough of a sports clip to relive the moment in full, yet not take substantial time away from the present. Further, the multiple playback capability of this invention and its ability to play anywhere from two to more than ten different highlights in consecutive order, allows the user to enjoy the sports highlights without being burdened with listening to more highlights than he or she chooses or hearing the same highlights over and over again. Even some favorite sports, history or entertainment highlights can become monotonous when played over and over without variety.

The present invention addresses the unique characteristics of sports and entertainment highlights, providing the ideal medium for their playback. Its small size allows for incorporation of highlights into any number of novelty devices or memorabilia. Its electronic makeup gives it increased durability compared with its mechanical counterparts. The length of this invention's sound bytes provides ample opportunity for the set-up of an event, the event itself and the follow-up or crowd reaction to an event, while, at the same time, having time limitations which protect the user from the anti-climatic monotony which might result from replaying larger segments of such events. The multiple playback capabilities of this invention in the sports arena, for example, provide for variety and an opportunity to relive several different moments from a certain game, a certain season, eras in a player's sports career or relating to a favorite sports team's history. Its consecutive playback ability prevents overplay and, therefore, a loss of some of the excitement of reliving the sports moment. Finally, this invention's non-continuous playback function allows a user, who may or may not wish to hear the next play in order, to fully enjoy the sports play at hand or, should he or she so choose, to reactivate the appropriate switch and continue on with the next play.

To enhance the experience of hearing the highlight, the playback circuitry is associated with visual cues relating to the highlighted event. For example, in one embodiment of the invention, a traditional music box or keepsake box may include pictures or related artwork representative of the highlight being audibly reproduced. With the activation switch being coupled to the cover of the box, a person may initiate the playback by opening the box. Highlights in other items may be triggered by the pushing of a button or picking up the memorabilia or novelty item. Simultaneously, with the starting of the highlight's audio reproduction, the listener then has the visual sensation of a photo or drawing of the event being evoked by the speaker. Also, the tactile sensation of opening the gift box, or activating or initiating playback, and the attendant visual stimulus, all coincide to make the listener remember the same sense of excitement as when the event first occurred. Along with the gift box/music box embodiment of the invention, several other physical forms may be utilized to create the visual stimuli for the desired visual cue to the audio highlights such as: actual, miniature, or desktop-sized footballs, baseballs, bats, basketballs or hockey pucks; trading cards; plaques and picture frames; clocks; small, to-scale car models or similar models; movie character dolls; toys and related memorabilia; miniature juke boxes; model radios and other memorabilia or novelty items related to any number of highlights of notable sports and news events, movies, music or television programs.

Sports is simply one area in which nostalgia plays an important part, however. Music, current events, theater, television shows and movies can all have the effect of setting a person's mind and imagination adrift on memories. This invention provides its user the opportunity to relive those news, music, television, theater, movie and personal events through its playback technology. From event-related memorabilia to products such as toys and board games, the unique characteristics of this invention provide an ideal medium for the replay of highlight compilations. As discussed above, the length of the highlight, the size and durability of this invention and the rendering of multiple, consecutive, and non-continuous playback all combine to form a technology for today, to be incorporated into products highlighting the memorable moments of yesterday.

The present invention, in one form, is a microelectronic device capable of audio playback of highlights. The device comprises a power source, an actuator, a storage device, and retrieval and reproduction device. The storage device digitally stores a plurality of highlights. The retrieval and reproduction device audibly reproduces one of the highlights when actuated by the actuator.

In another form of the invention, the above-mentioned device is disposed within an enclosure with a lid, and the actuator is coupled to the door. When the door opens, the device starts replaying a highlight, and when the door closes the device halts the replay. Upon subsequent reopening, a new highlight begins.

In yet another form of the present invention, the playback feature may be used to store and to play back selected musical pieces from a selected composer, movie, musical, cartoon, play, etc. This playback feature may be incorporated into such items as a traditional music box in which jewelry, keys, change, and other paraphernalia may be stored. According to the present invention, when the music box lid is opened a selected feature will play. When the lid is closed the playback feature automatically advances to the next selection. When the lid is subsequently opened the playback device begins playing the next successive selection stored in the playback device. In one manner of operating the invention, by opening and closing the lid in rapid succession a user may rapidly scroll through the stored selections until selecting the desired choice and leaving the lid open for listening pleasure. The particular selection stops at its end, without further action by its user.

In another embodiment of the present invention, the playback apparatus may be incorporated in a base or other object on which is displayed various memorabilia, such as sports trading cards, baseballs, footballs, hockey pucks, historical objects, to-scale models, objects of entertainment, etc. In lieu of opening and closing the lid to activate and deactivate the playback device, a push-button or other such device may be placed upon an exposed surface of the base to permit user queuing for activating and deactivating the playback feature. In one manner of operating the invention, by depressing the push-button the playback device will begin playing the first stored playback selection, such as an excerpt from a game, a broadcast, a personal statement by an individual subject, a prerecorded message detailing statistical information or other facts relating to an individual subject, etc. By successively depressing the push-button the user may scroll through the set of stored informational highlights until reaching the desired choice. The playback feature may be deactivated by depressing the press button during the playback of any given selection. Other known methods for queuing stored playback selections are fully contemplated and may be alternatively implemented by the present invention.

In some embodiments of the present invention, it is possible for the memory storage component to be a replaceable piece, giving users yet another opportunity for variety and

BRIEF DESCRIPTION OF THE DRAWINGS

The above-mentioned and other features and objects of this invention and the manner of attaining them, will become more apparent and the invention itself will be better understood by reference to the following description of an embodiment of the invention taken in conjunction with the accompanying drawings, wherein.

Figure 1:
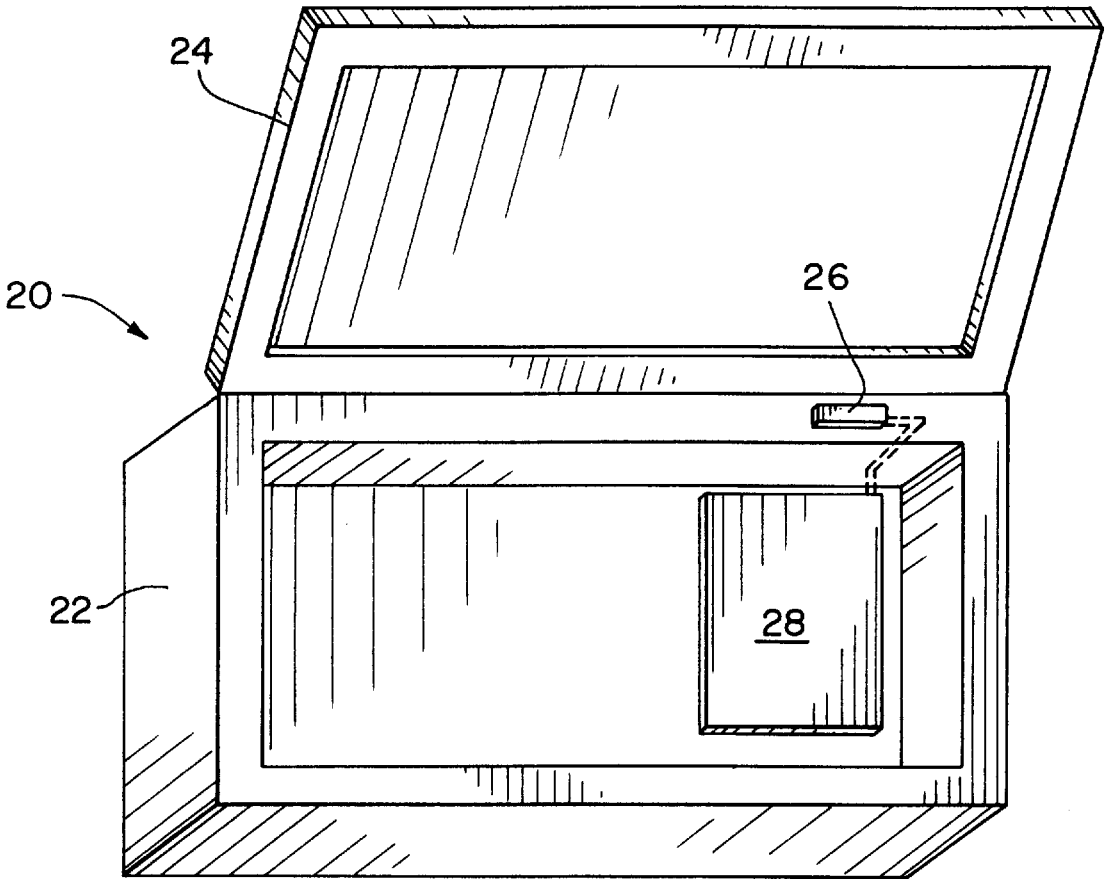
FIG. 1 is a perspective view of a gift box incorporating the microelectronic device of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF THE PRESENT INVENTION

The embodiment disclosed below is not intended to be exhaustive or limit the invention to the precise form disclosed in the following detailed description. Rather, the embodiment is chosen and described so that others skilled in the art may utilize its teachings.

As set forth in the disclosure below, the term "highlight refers to a portion of audio content which encompasses a time period of preferably ten (10) to one hundred and twenty (120) seconds. Thus, a "highlight" is sufficiently long to cover a significant event, e.g., a portion of a political speech, a play from a sporting event, a climatic point of a drama, movie, musical or a broadcast news event, to name only a few of the possible "highlights". Accordingly, any reference to an audio reproduction or audio storage in the disclosure below relates to a segment of sufficient audio information to constitute a highlight. The audio playback device of the present invention has the capacity to store preferably three or more such highlights, all related to a particular subject, such as a sports team, sports figure, historical figure, work of art, etc.

The present invention may be used in a gift box, music box or keepsake box such as shown in FIG. 1. Gift or jewel box 20 is an enclosure which includes base 22 and a hingedly attached lid or door 24. Switch 26, in the exemplary embodiment, is mounted in base 22 and is coupled to circuit board 28 also disposed in base 22. Switch 26 is open and inactivated when lid 24 rests atop base 22. Switch 26 is structured and arranged on base 22 in such a way that switch 26 closes when lid 24 is opened. As described in greater detail below, when lid 24 is opened, the closing of switch 26 activates circuit board 28.

Alternatively, switch 26 may be activated by other means, such as a push-button on the exterior of the enclosure, a pressure sensitive switch on the bottom of the enclosure, or a light sensitive sensor/switch. In the exemplary embodiment, switch 26 activates the playback of the highlight, while the deactivation of switch 26 causes cessation of the highlight replay. When switch 26 is subsequently activated, a next highlight is replayed from its beginning. The next highlight may be the next successive highlight in a sequential series of highlights, or a randomly selected highlight (possibly even the same highlight if desired).

In the exemplary embodiment, gift box 20 includes visual material related to the subject of the audio highlights stored within circuit board 28. For example, the exterior of gift box 20 may have artwork or symbols representing the individual, work(s) of art, event or organization featured by the highlights. Lid 24 and the interior of base 22 may also include more specific visual images—e.g., photos or drawings—relating to the event, individual or organization which is the subject of one or more highlights. For example, if the highlights relate to the speeches of a historical figure, then the exterior of gift box 20 may include a likeness of the historical figure with specific photos or drawings of the historic figure relating to the highlight. For sporting event highlights, the exterior of gift box 20 may include a team name or logo, with the interior including photos, cards or drawings from the specific events recounted in the audio highlights. With dramatic works, the exterior may include a representation of the author while the interior may include drawings from the events of the play or movie, or vice-versa.

Figure 2:
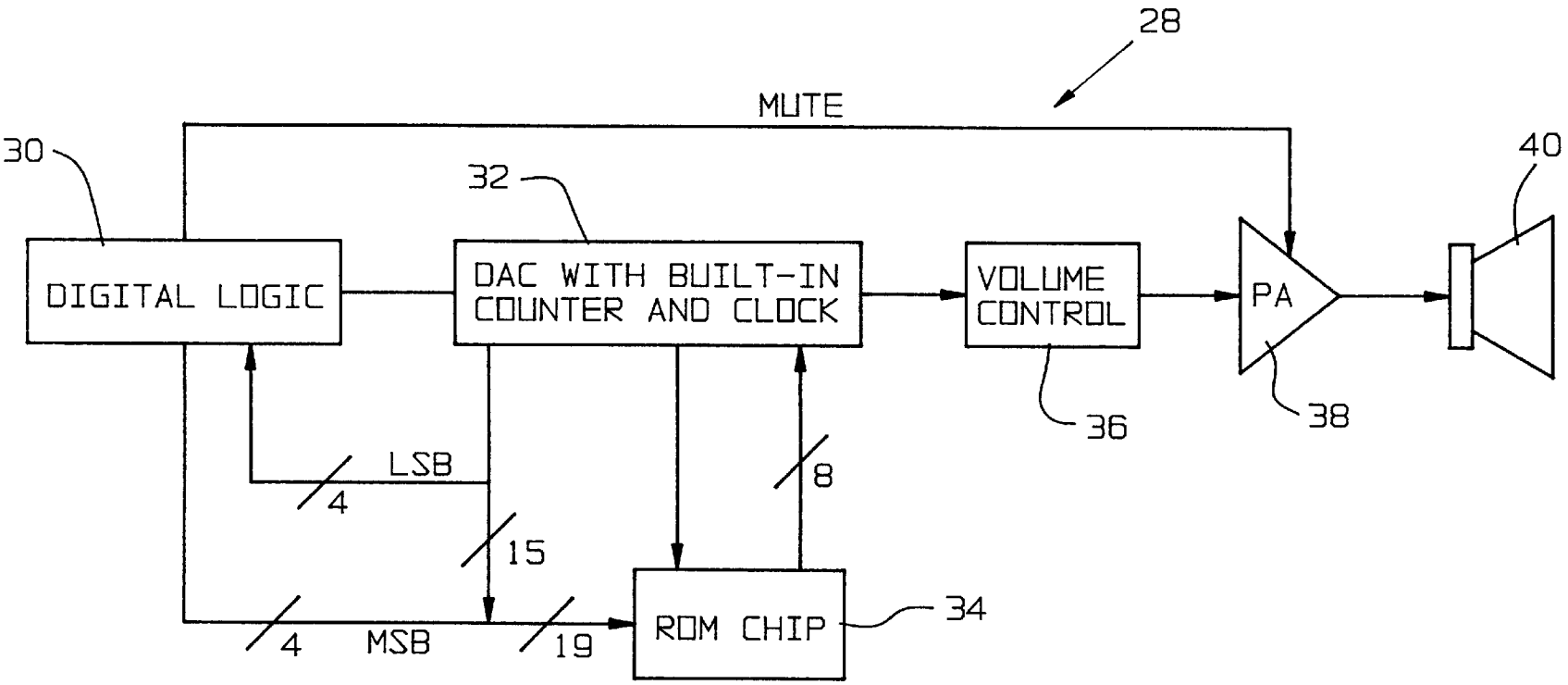
FIG. 2 is a schematic view of the circuit board of the microelectronic device of the present invention.

Relating to the electronics for reproducing the audio highlights, circuit board 28 includes the microelectronic circuitry capable of replaying a plurality of audio highlights generally in the range of 10 to 120 seconds in a sequential or a pseudo-random playback order. FIG. 2 schematically shows the arrangement of microelectronic logic and storage which provides the inventive playback features. Preferably, the storage and playback capability of circuit board 28 is at least sufficient to reproduce a minimum of three highlights each of at least 10–20 seconds, twenty spoken words or some other comparable measurement, however most appropriately evaluated. This is believed to be the minimum capacity required to adequately convey to the listener the highlighted musical piece, the highlighted moment in history, sports etc., the feel of the season, such as Christmas, etc. The number of highlights capable of being reproduced by the circuit is dependent upon the amount of information contained in each highlight. Accordingly, a greater number of highlights may be stored and reproduced if the highlights are of relatively short duration. Additional memory may be added to the circuit to provide greater capacity within space constraints of the size of the physical dimension of the gift box.

In the exemplary embodiment of the present invention, Digital logic or processor 30 controls the operation of circuit board 28 with the assistance of DAC chip 32' of DAC 32. DAC 32 includes a counter and clock to aid in the sequencing and timing of the audio playback, for example at a sample rate of 4 kHz. DAC chip 32' and logic 30 cooperate to retrieve the audio highlights digitally stored on read-only memory (ROM) chip 34 in the proper sequence or randomly. In the exemplary embodiment, the audio information is stored as a series of 8-bit words on ROM chip 34, which has a 512K by 8 bit storage capacity, addressable by a 19 bit word.

For versatility, ROM chip 34 may be selected from a group of interchangeable ROM chips, which contain different selections of highlights. ROM chip 34 is interchangeable with other compatible ROM chips from this group thereby providing the versatility for exchanging one highlighted subject with another or updating highlights. In order to replace ROM chip 34 with a second ROM chip of similar design, circuit board 28 must be provided with a ROM chip receiving and docking device (not shown), or some means for removably receiving the ROM chip. Chip removing tongs are operated so as to engage the body of the ROM chip, an upward force is then applied in a direction away from circuit board 28 to spatially separate ROM chip 34 from the board and disengage the leads associated with the ROM chip from the circuit board. After the ROM chip has been removed, a second ROM chip of similar design may be attached to the circuit board at the same location as chip 34 by aligning the leads with the receiving slot connectors and applying a downward force on the second ROM chip in the direction of the circuit board. Accordingly, the circuit should be designed so that the ROM chip is accessible when ROM interchangeability is a desired feature.

Figure 3A:
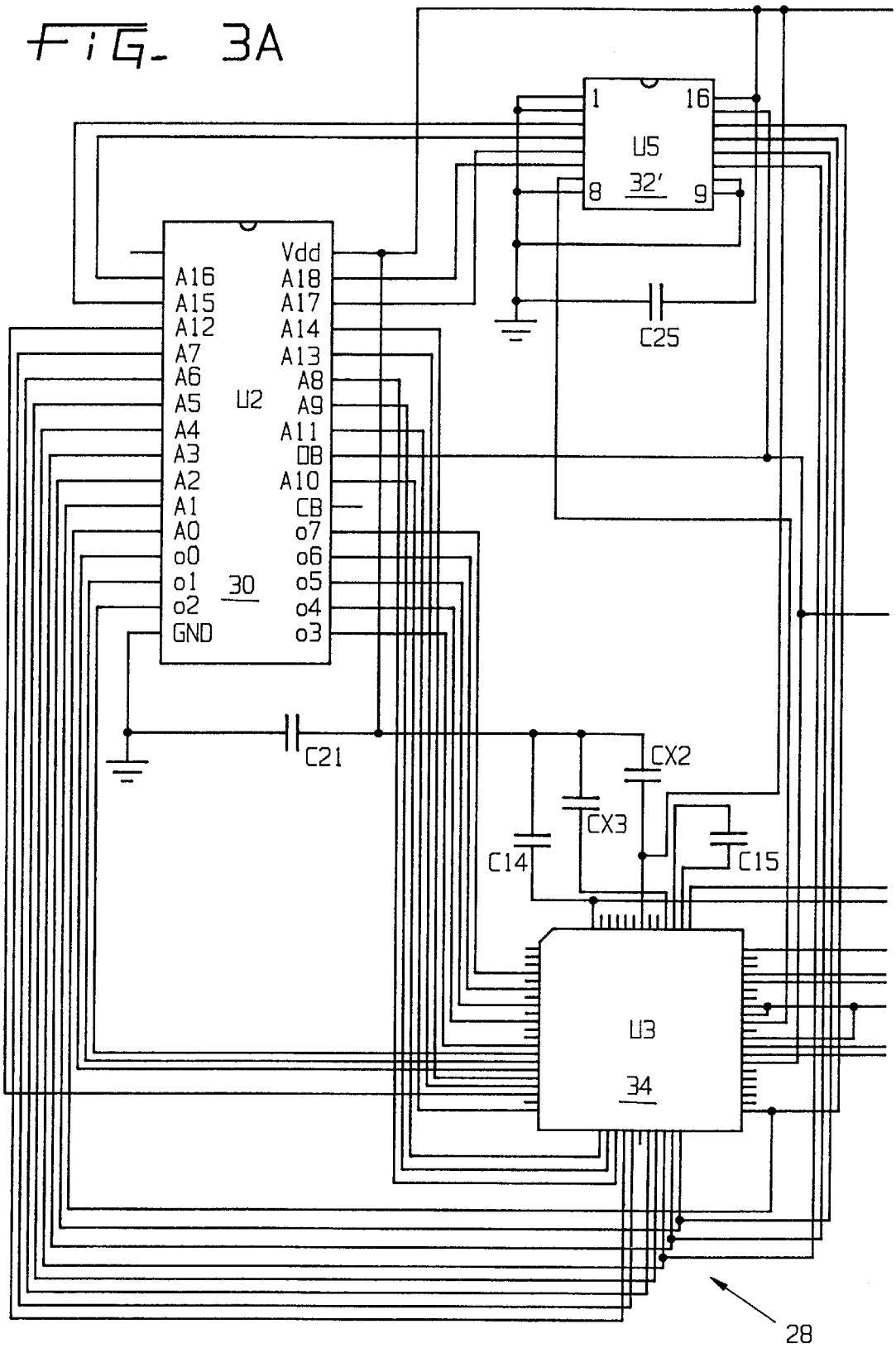
FIG. 3A is a circuit diagram of part of the circuit board of FIG. 2.
Figure 3B:
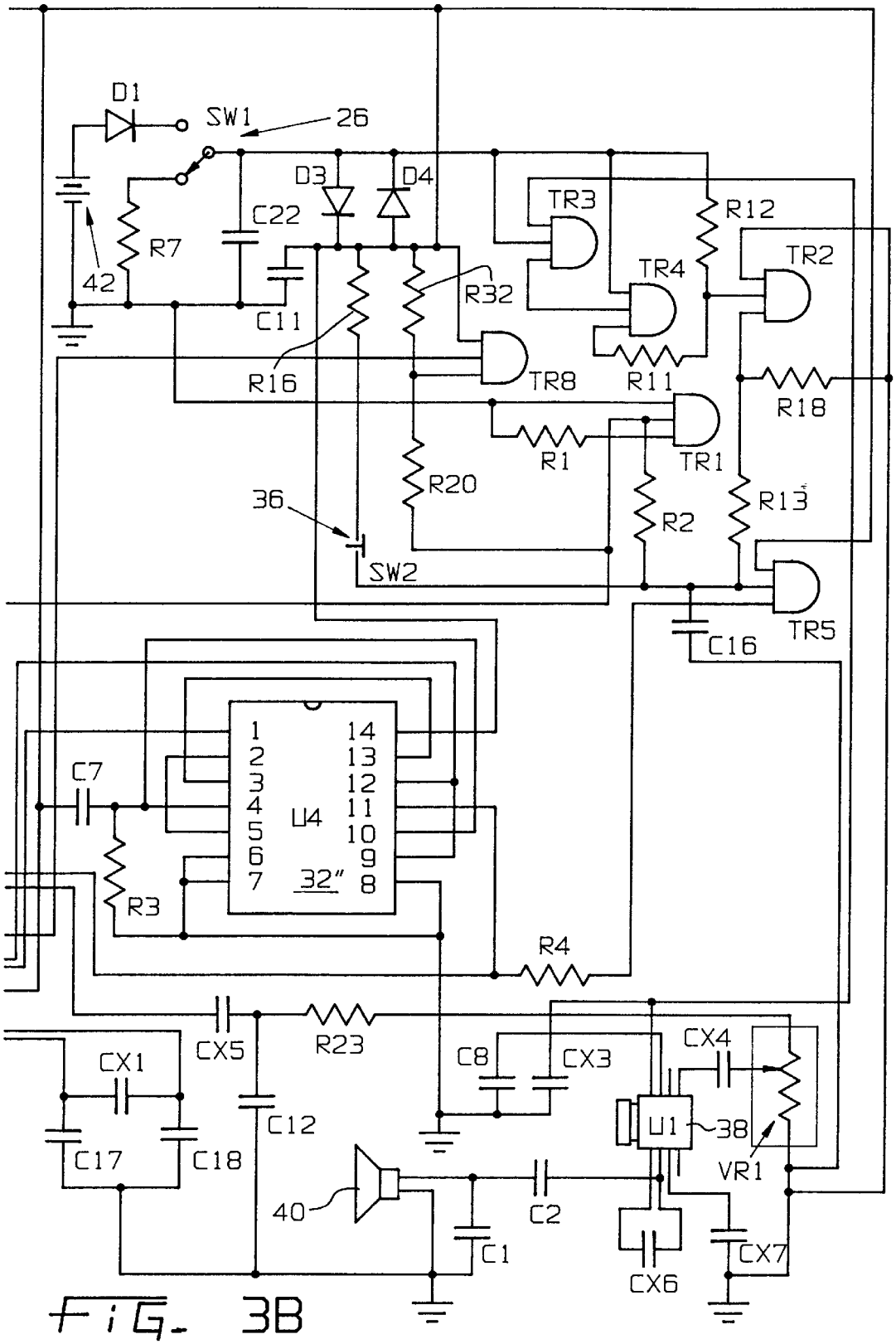
FIG. 3B is a circuit diagram illustrating the remainder of the circuit board of FIG. 2 not shown in FIG. 3A.

Based on the digitally encoded audio information stored on ROM chip 34, DAC 32 transmits analog audio signals to volume control (VR1), 36, which appropriately modifies the audio signal before transmitting the signal to power amplifier (PA) 38. Power amplifier 38 then transmits a driving signal to speaker 40 for generation of the audio reproduction of the digitally stored information in ROM chip 34. FIGS. 3A and 3B show a detailed circuit diagram of circuit board 28 of FIG. 2 wherein DAC, 32 in FIG. 2, is embodied by two separate components, chip 32' for the counter and clock functions and chip 32" for the digital signal to analog signal conversion. FIGS. 3A and 3B also show one embodiment of auxiliary circuitry used to implement the microelectronic circuitry in such a way as to maximize the longevity of battery 42 without sacrificing performance in terms of responsiveness, memory, or volume capability of gift box 20. The following table provides a listing of values used in the preferred embodiment of circuit board 28.

TABLE OF VALUES

| Resistors | | Capacitors | | Capacitors | |
|---|---|---|---|---|---|
| R1 | 10KΩ | C1 | 104 μF | CX1 | |
| R2 | 57KΩ | C2 | 220 μF | CX2 | 104 μF |
| R3 | 51KΩ | C7 | 10 μF | CX3 | 104 μF |
| R4 | 57KΩ | C8 | 470 μF | CX3 | 220 μF |
| R7 | 10KΩ | C11 | 104 μF | CX4 | |
| R11 | 57KΩ | C12 | 103 μF | CX5 | 104 μF |
| R12 | 10KΩ | C14 | 472 μF | CX6 | 100 μF |
| R13 | 57KΩ | C15 | 0.47 μF | CX7 | 220 μF |
| R16 | 10KΩ | C16 | 1 μF | | |
| R18 | 51KΩ | C17 | 101 μF | | |
| R20 | 57KΩ | C18 | 101 μF | | |
| R23 | 51KΩ | C21 | 104 μF | | |
| R32 | 57KΩ | C22 | 220 μF | | |
| | | C25 | 104 μF | | |

In this exemplary embodiment, as shown in FIG. 1, circuit board 28 is approximately 4 inches by 3 inches by 2 inches in size or smaller and rectangular in shape. The circuit board 28 is capable of audio reproduction of highlight playbacks comprising music or voices stored digitally on ROM chip 34. The sound quality need not be stereo quality, however the digital reproduction techniques of microelectronics affords relatively high quality audio reproduction. The reproduction must be of sufficient sound quality to effectively communicate the highlight and evoke the desired response from the user. Speaker 40 may be covered within base 22, and volume control VR1 is an optional feature.

Circuit board 28 is activated by switch 36 which is incorporated into gift box 20. Once activated, circuit board 28 will play a 10–120 second audio highlight. Upon successive activations, digital logic or processor 30 indexes ROM chip 34, i.e., provides an instruction relating to a memory address of ROM chip 34. The programming stored in ROM chip 34 contains instructions which can cause a consecutive order of playbacks or a pseudo-random order. In this manner, a plurality of different highlights are, via DAC 32, played consecutively or in a pseudo-random order. Only one highlight is played each time circuit board 28 is activated.

Although a gift box is used as an exemplary embodiment, circuit board 28 may alternatively be disposed in other novelty items, e.g., sports and entertainment memorabilia, cards, frames, statuettes, key chains, clocks, and similar items. Circuit board 28 is powered with conventional batteries represented by battery 42. Alternatively, battery 42 may be supplemented by a solar cell, a wall plug and transformer arrangement or a magnetic or mechanical reenergizing device.

Power Amplifier 38 may also include a muting function to improve sound quality. One possible source of voltage spikes in the exemplary embodiment is the successive activation and deactivation of circuit board 28. The muting function eliminates undesirable noise from reaching the speaker and causing any hissing or undesirable sound deviations. An additional circuit protection feature which may be included involves placing diodes in series with the battert connections to prevent potential damage caused by reversal of polarity of the batteries.

The audio highlight playback circuitry described above may contain multiple selections of highlights excerpted from among other things, a game, a series of games, a season, a career, a franchise history, a movie, a scene, a play, thematically related songs, etc. These highlights may relate to an individual, a particular team, a particular sport, a particular category of players or performers (such as singers, actors, hitters, sluggers, pitchers, quarterbacks, etc.). From a historical perspective the highlights may be excerpted from speeches made during the life of a public figure, such as a president, politician, military leader, religious leader, etc. Fictional characters may also be the subjects of the present invention, such as cartoon characters, movie characters, etc. Selections can also be theme-based, such as holiday selections, musicals, etc.

Figure 4:
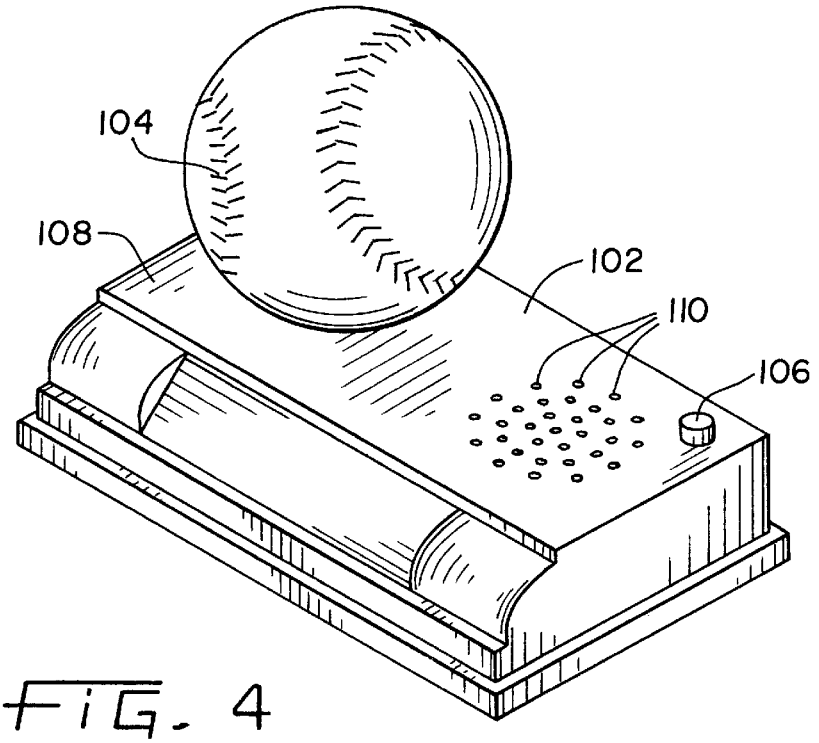
FIG. 4 is a perspective view of a memorabilia display base incorporating the microelectronic device of FIG. 2.

FIG. 4 illustrates the miniature audio highlight playback device of the present invention as incorporated in a sports memorabilia display and highlight playback base 100. Base 102 is shown supporting an object of sports memorabilia, baseball 104, which alternatively could be a football, basketball, hockey puck, soccer ball, tennis ball or racket, etc. Base 102 may alternatively be used to support objects of other pursuits, such as historical figures, awards, objects of children's entertainment, etc. Push-button 106 is provided on surface 108 of base 102 and operates to activate and deactivate the audio highlight playback circuitry as described hereinabove. Holes 110 are provided in surface 108 to facilitate dissemination of the audio playback selection as provided by a speaker (not shown) incorporated in base 102.

Figure 5:
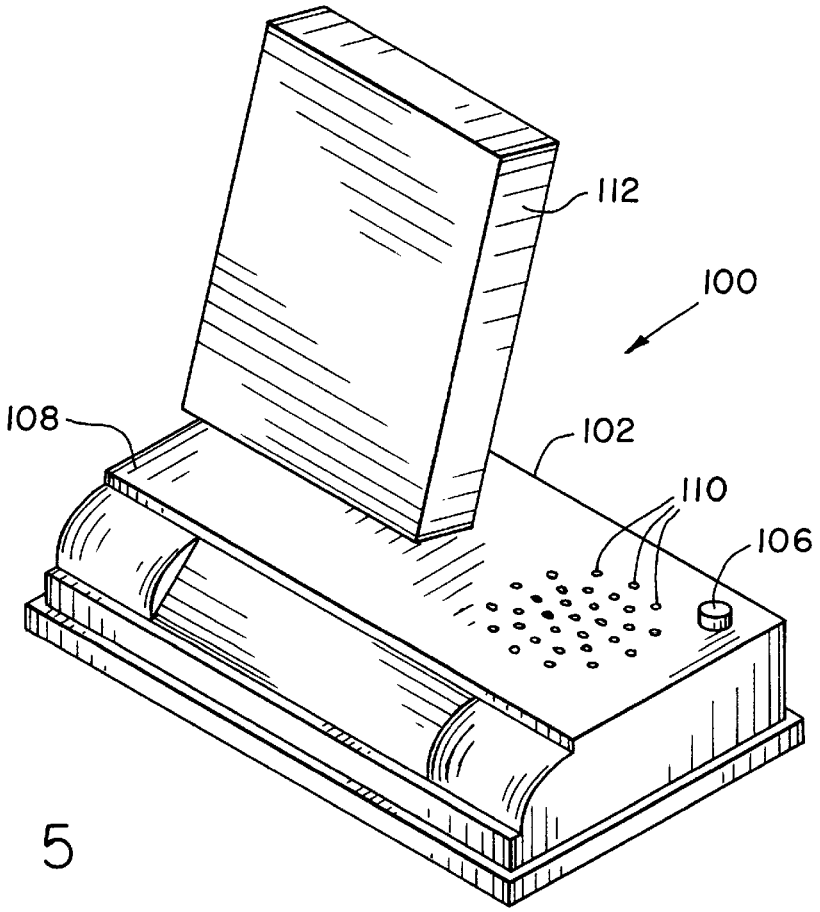
FIG. 5 is a perspective view of an alternative memorabilia display base incorporating the microelectronic device of FIG. 2.

FIG. 5 illustrates an alternative embodiment of the memorabilia base incorporating the audio highlight playback device of the present invention as described above. In lieu of baseball 104, playing card holder 112 is supported by base 102 on upper surface 108. Provision is made in card holder 112 to permit a user to insert or otherwise mount a traditional sports trading card, picture, etc. in holder 112. Baseball 104, which may have an autograph of a particular player or autographs of the players of a particular team, or be an actual pre-used baseball, and the card or other object to be mounted in holder 112, which may be a particular player or a particular team, are preferably related to the audio highlights stored in the audio highlight playback device mounted in base 102. It should be understood that the base may take on various forms within the contemplation of the present invention and that any number of sports, political, celebrity, etc., memorabilia may be the subjects of the audio highlight playback device of the present invention.

Figure 6:
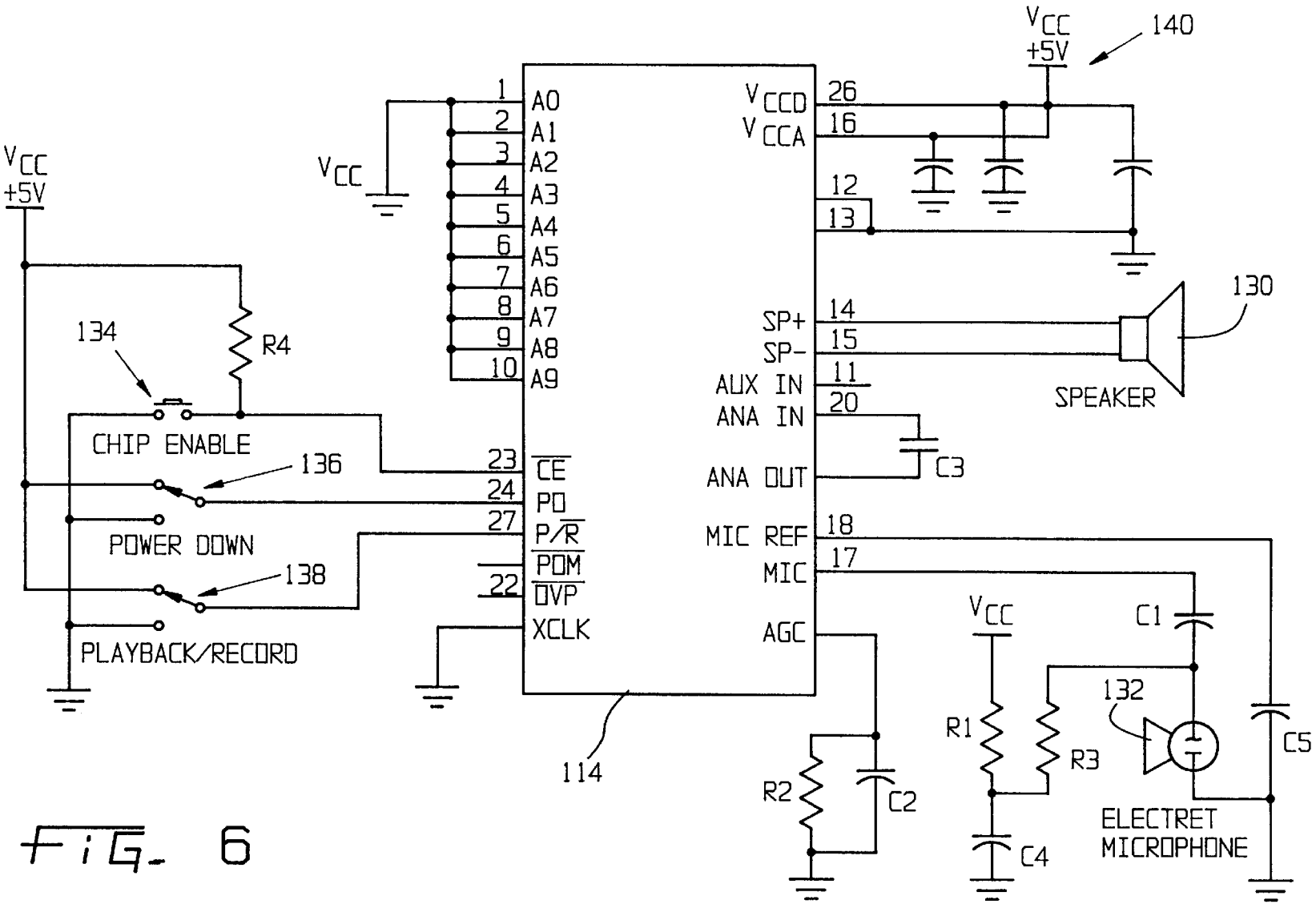
FIG. 6 is a circuit diagram of a "single-chip" embodiment of the microelectric device of the present invention.
Figure 7:
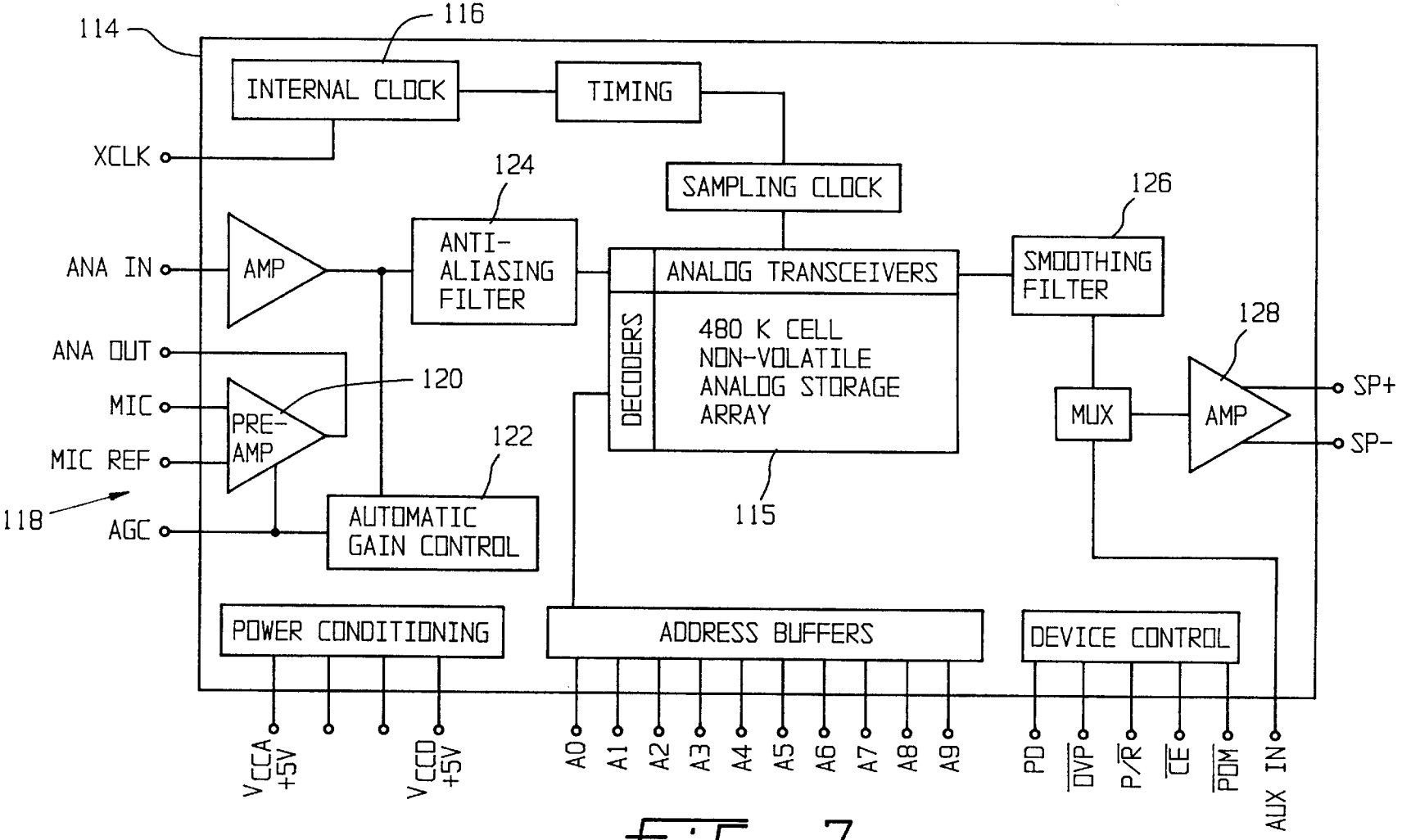
FIG. 7 is a detailed functional block diagram of the "single-chip" employed in the microelectric device of FIG. 6.

FIGS. 6 and 7 are circuit diagrams illustrating a single chip embodiment of the circuit of the present invention. A single integrated chip 114, such as the ISD2500 series or ISD1000 series as manufactured by ISD corporation, located in San Jose, Calif., provides record/playback solutions for 45–90 second messaging. Memory 115 for storing the highlight playback information, shown as a 480K cell non-volatile analog storage array, is addressable and segmentable so that multiple highlights may be stored and accessed. Each highlight is a fraction of the overall messaging capacity of the chip. As shown in FIG. 7, chip 114 is fully integrated and includes on-chip oscillator 116, microphone inputs 118, preamplifier 120, automatic gain control 122, anti-aliasing filter 124, smoothing filter 126, and speaker amplifier 128. An example of the basic device control is provided in the following table.

BASIC DEVICE CONTROL TABLE

| Control Step | Function | Action |
|---|---|---|
| 1 | Power up chip and select record/playback mode | 1. PD = LOW<br>2. P/$\overline{R}$ = As desired |
| 2 | Set message address for record/playback | Set addresses A0–A7 |
| 3A | Begin playback | P/$\overline{R}$ = HIGH<br>$\overline{CE}$ = Pulsed LOW |
| 3B | Begin record | P/$\overline{R}$ – LOW<br>$\overline{CE}$ = LOW |
| 4A | End playback | Automatic |
| 4B | End record | PD or $\overline{CE}$ = HIGH |

Chip 114 provides a "system on a chip" and is fully microprocessor compatible for achieving complex messaging and addressing. Only a microphone 132, speaker 130, power source implement a complete record/playback system. A table describing the functions of the passive elements is provided below. Recorded highlights are stored in on-board non-volatile memory storage array 115 which provides zero power message storage. Chip 114 incorporates direct analog storage technology whereby voice and audio signals are directly stored in memory 115 of the chip in their natural form. This permits "natural voice" reproduction in a single-chip, solid state solution. This technology provides direct storage of information, without conversion from analog to digital, into standard EEPROM (electrically erasable programmable read only memory) memory cells. By utilizing a multi-level storage technique, chip 114 is capable of storing up to eight times the information per memory cell as compared to conventional digital solutions.

PASSIVE COMPONENT FUNCTION TABLE

| Part | Function | Comments |
|---|---|---|
| R1 | Microphone power supply decoupling | Reduces power supply noise |
| R2 | Release time constant | Sets release time for AGC |
| R3 | Microphone biasing resistor | Provides biasing for microphone operation |
| C1 | Microphone DC-blocking capacitor<br>Low-frequency cutoff | Decouples microphone bias from chip.<br>Provides single-pole low-frequency cutoff |
| C2 | Attack/Release time constant | Sets attack/release time for AGC |

-continued

PASSIVE COMPONENT FUNCTION TABLE

| Part | Function | Comments |
|---|---|---|
| C3 | Low-frequency cutoff capacitor | Provides additional pole for low-frequency cut-off |
| C4 | Microphone power supply decoupling network | Reduces power supply noise |
| C5 | Common-mode capacitor | Provides common-mode noise rejection |

A power source provides a circuit control voltage 140 for use in the circuit. Power switch 136 may be provided to permit a user to selectively turn the circuit "on" and "off." Chip enable switch 134 is provided to enable chip 114 to initiate highlight playback, the highlights stored in memory 115 may be scrolled through until a desired highlight is reached by actuating switch 134 in a successive manner. Switch 138 selects the particular operating mode of chip 114 between record mode and playback mode.

By providing a microelectronic audio highlight playback device having sufficient memory to store multiple replays of memorable historical events and by providing a playback device capable of scrolling through a series of highlights associated with a particular individual, team, era, collection of an individual's works, holiday or season, etc., the present invention captures a nostalgic spectrum. This idea of a "full picture" or "full story" memorabilia is an important aspect to this invention. The technology described herein possesses a heretofore missing ability to truly capture a whole game, career, life, musical or movie, rather than a mere single "snap shot" highlight. A user can relive a complete game by hearing portions from the beginning, middle, and end, remember a whole movie or social moment, a musician's entire career, or rekindle different holiday feelings through different holiday songs, from traditional to religious to popular. By recognizing that life's memorable moments are made up of many facets, this invention provides a complete perspective and allows its user to better re-live a collection of memorable moments, yet in a timely manner.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A compact and hand-held microelectronic device capable of audio playback of highlights, said device comprising:

an electric power source;

an actuator having a first position and a second position;

a circuit board coupled to said electric power source and said actuator, said circuit board including:

means for storing a plurality of highlights in analog form in addressable memory cells; and means for audibly reproducing one of said highlights from said storing means when actuated by said actuator transitioning from said first position to said second position, said reproducing means operatively connected to said storing means and having an input adapted to receive stored highlights therefrom, said power source operatively connected to said storing means and said reproducing means and adapted to provide a source of power thereto, said reproducing means successively playing different ones of said plurality of highlights upon each successive actuation of said actuator.

2. The audio playback device of claim 1 wherein said actuator comprises a light sensitive sensor.

3. The audio playback device of claim 1 wherein said actuator comprises a mechanically actuatable switch.

4. The audio playback device of claim 3 wherein said mechanically actuatable switch comprises a push-button switch.

5. The audio playback device of claim 1 wherein said reproducing means comprises a power amplifier and a speaker.

6. The audio playback device of claim 1 wherein each of said highlights is at least ten seconds in duration.

7. The audio playback device of claim 1 wherein said plurality of highlights comprises at least three highlights.

8. The audio playback device of claim 1 further comprising means for adjusting the output volume of said reproducing means.

9. The audio playback device of claim 1 wherein said storing means is capable of storing at least three highlights each containing a message of at least twenty words or 10–20 seconds in duration.

10. The audio playback device of claim 1 wherein said storing means is interchangeable with a second means for storing a second plurality of highlights.

11. The audio playback device of claim 1 wherein said storing means is randomly accessible.

12. The audio playback device of claim 1 wherein said audible reproducing means includes a means for muting noise such as caused by voltage spikes.

13. A compact and hand-held microelectronic device for replaying a plurality of pre-recorded audio excerpts comprising:

a container;

a lid disposed on said container;

means for sensing when said lid is opened and closed and for generating a signal indicating whether said lid is open or closed;

an electric power source;

a circuit board disposed within said container and coupled to said elelctric power source and said sensing means; said circuit board including:

means for storing said plurality of audio excerpts in analog form in addressable memory cells;

means for audibly reproducing said audio excerpts; and control means receiving said signal and indexing said storing means, said control means coupled to said storing means and said reproducing means, said control means selecting one of said audio excerpts responsive to said signal, said reproducing means having an input adapted to receive said audio excerpts, said power source operatively connected to said storing means, said reproducing means, and said control means and adapted to provide a source of power thereto, said reproducing means successsively playing different ones of said plurality of audio excerpts upon each successive signal generated by said sensing means.

14. The audio playback device of claim 13 wherein said sensing means comprises a light sensitive sensor.

15. The audio playback device of claim 13 wherein said sensing means comprises a mechanically activated switch.

16. The audio playback device of claim 15 wherein said mechanically activated switch is a push-button switch.

17. The audio playback device of claim 13 wherein said reproducing means comprises a power amplifier and a speaker.

18. The audio playback device of claim 13 wherein each of said audio excerpts is at least ten seconds in duration.

19. The audio playback device of claim 13 wherein said plurality of audio excerpts comprises at least three excerpts.

20. The audio playback device of claim 13 further comprising a means for adjusting the volume of the audible reproduction.

21. The audio playback device of claim 13 wherein said device is capable of storing at least three excerpts each having a duration of at least ten seconds.

22. The audio playback device of claim 13 wherein said storing means containing said excerpts is capable of being replaced with a second storing means containing a second selection of excerpts.

23. The audio playback device of claim 13 wherein said storing means is randomly accessible.

24. The audio playback device of claim 13 wherein said control means sequentially indexes said storing means to selectively replay said excerpts in a predetermined sequence upon successive opening and closing of said lid.

25. The audio playback device of claim 13 wherein said control means randomly indexes said storing means to randomly replay said excerpts in a random sequence upon successive opening and closing of said lid.

26. A compact and hand-held microelectronic device for replaying a plurality of pre-recorded audio excerpts comprising:

a base for supporting an object of interest wherein said audio excerpts relate to said object of interest;

an electric power source;

an actuator having a first position and a second position, and capable of generating a signal for prompting audio excerpt playback;

a circuit board within said base and coupled to said electric power source and said actuator, said circuit board including:

means for storing said plurality of audio excerpts in analog form in addressable memory cells;

means for audibly reproducing said audio excerpts; and control means receiving said signal and indexing said storing means, said control means coupled to said storing means and said reproducing means, said control means selecting one of said audio excerpts responsive to said signal, said reproducing means having an input adapted to receive said audio excerpts, said power source operatively connected to said storing means, said reproducing means, said control means and adapted to provide a source of power thereto, said reproducing means successively playing different ones of said plurality of audio excerpts upon each successive actuation of said actuator.

27. The audio playback device of claim 26 wherein said control means sequentially indexes said storing means to selectively replay said excerpts in a predetermined sequence upon successive actuation of said actuator.

28. The audio playback device of claim 26 wherein said control means randomly indexes said storing means to randomly replay said excerpts in a random sequence upon successive actuation of said actuator.

29. The audio playback device of claim 26 wherein said indexing means comprises a mechanically activated switch.

30. The audio playback device of claim 29 wherein said mechanically activated switch is a push-button switch.

31. The audio playback device of claim 26 wherein said reproducing means comprises a power amplifier and a speaker.

32. The audio playback device of claim 26 wherein each of said audio excerpts is at least ten seconds in duration.

33. The audio playback device of claim 26 wherein said plurality of audio excerpts comprises at least three excerpts.

34. The audio playback device of claim 26 further comprising means for adjusting the output volume of said reproducing means.

35. The audio playback device of claim 26 wherein said storing means is capable of storing at least three excerpts each having a duration of at least ten seconds.

36. The audio playback device of claim 26 wherein said storing means is capable of being replaced with a second means for storing a second plurality of excerpts.

37. A compact and hand-held music box capable of playing a musical excerpt from a plurality of musical excerpts, said music box comprising:

a lid alternately positionable between an open position and a closed position;

means for sensing when said lid is opened and closed and for generating a signal indicating whether said lid is open or closed; and a microelectronic device coupled to said sensing means and disposed within said compact and hand-held music box for replaying said musical excerpt, said microelectronic device including:

an electric power source;

means for storing said plurality of musical excerpt in analog form in addressable memory cells;

means for audibly reproducing said musical excerpts; and control means receiving said signal and indexing said storing means, said control means operatively disposed between said storing means and said reproducing means, said control means selecting one of said audio excerpts responsive to said signal, said reproducing means having an input adapted to receive said audio excerpts, said power source operatively connected to said storing means, said reproducing means, and said control means and adapted to provide a source of power thereto, said reproducing means successively playing different ones of said plurality of musical excerpts upon each successive signal generated by said sensing means.

38. The music box of claim 37 wherein said control means sequentially indexes said storing means to selectively replay said excerpts in a predetermined sequence upon successive opening and closing of said lid.

39. The music box of claim 37 wherein said control means randomly indexes said storing means to randomly replay said excerpts in a random sequence upon successive opening and closing of said lid.

40. The music box of claim 37 wherein said sensing means comprises a mechanically activated switch.

41. The music box of claim 40 wherein said mechanically activated switch is a push-button switch.

42. The music box of claim 37 wherein said sensing means comprises a light sensitive sensor.

43. The music box of claim 37 wherein said reproducing means comprises a power amplifier and a speaker.

44. The music box of claim 37 wherein each of said music excerpts is at least ten seconds in duration.

45. The music box of claim 37 wherein said plurality of musical excerpts comprises at least three excerpts.

46. The music box of claim 37 further comprising a means for adjusting the output volume of said reproducing means.

47. The music box of claims 37 wherein said storing means is capable of storing at least three excerpts each having a duration of at least ten seconds.

48. The music box of claim 37 wherein said storing means is interchangeable with a second means for storing a second plurality of musical excerpts.

* * * * *

UNITED STATES PATENT AND TRADEMARK OFFICE

CERTIFICATE OF CORRECTION

PATENT NO : 5,973,250

DATED : November 10, 1999

INVENTOR(S): Anthony M. Zirille et al.

It is certified that error appears in the above-identified patent and that said Letters Patent is hereby corrected as shown below:

Claim 13, Column 12, Line 46 change "elelctric" to --electric--

Claim 26, Column 13, Line 39 change after "board" insert --disposed--

Claim 26, Column 13, Line 52 after "means," insert --and--

Signed and Sealed this

Twenty-seventh Day of June, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,973,250
DATED : October 26, 1999
INVENTOR(S) : Anthony M. Zirille et al.

It is certified that error appears in the above-identified patent and that said Letters Patent is hereby corrected as shown below:

Title page,
Item [73], please change the name of the Assignee to -- Anthony M. Zirille --

Signed and Sealed this

Twenty-seventh Day of August, 2002

*Attest:*

*Attesting Officer*

JAMES E. ROGAN
*Director of the United States Patent and Trademark Office*